US006952941B2

(12) United States Patent
Friedman et al.

(10) Patent No.: US 6,952,941 B2
(45) Date of Patent: Oct. 11, 2005

(54) APPARATUS AND METHOD FOR FORMING AN ARTICLE AND PERFORMING A SECONDARY OPERATION IN-SITU

(75) Inventors: Peter Friedman, Ann Arbor, MI (US); Richard Allor, Livonia, MI (US); George Luckey Jr., Dearborn, MI (US); Warren Copple, Trenton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 32 days.

(21) Appl. No.: 10/707,328

(22) Filed: Dec. 5, 2003

(65) Prior Publication Data

US 2005/0120766 A1 Jun. 9, 2005

(51) Int. Cl.[7] ..... B23P 17/00; B21D 9/15; B21D 26/02

(52) U.S. Cl. ..... 72/57; 72/55

(58) Field of Search ..... 72/55, 57, 58; 29/421.1, 514

(56) References Cited

U.S. PATENT DOCUMENTS

| | | | | | |
|---|---|---|---|---|---|
| 3,487,668 | A | * | 1/1970 | Fuchs, Jr. | 72/55 |
| 3,934,441 | A | | 1/1976 | Hamilton et al. | |
| 4,426,032 | A | | 1/1984 | Leodolter | |
| 4,502,309 | A | | 3/1985 | Hamilton et al. | |
| 4,509,671 | A | | 4/1985 | Weisert | |
| 5,050,299 | A | | 9/1991 | Rainville | |
| 5,070,717 | A | * | 12/1991 | Boyd et al. | 72/55 |
| 5,890,285 | A | | 4/1999 | Pruitt et al. | |
| 5,916,316 | A | | 6/1999 | Fischer | |
| 6,039,239 | A | | 3/2000 | Collier et al. | |
| 6,158,122 | A | * | 12/2000 | Skudutis | 29/897.2 |
| 6,264,880 | B1 | | 7/2001 | Elmer et al. | |
| 6,418,607 | B1 | * | 7/2002 | Seifert et al. | 29/421.1 |
| 6,513,359 | B1 | | 2/2003 | Binder et al. | |
| 6,547,895 | B2 | | 4/2003 | Bradley et al. | |
| 6,591,648 | B1 | * | 7/2003 | Ash et al. | 72/55 |
| 6,658,908 | B1 | * | 12/2003 | Ghiran et al. | 72/55 |
| 6,662,611 | B2 | * | 12/2003 | Janssen et al. | 72/55 |
| 2001/0053427 | A1 | | 12/2001 | Elmer et al. | |
| 2002/0003011 | A1 | | 1/2002 | Dykstra et al. | |

* cited by examiner

*Primary Examiner*—David B. Jones
(74) *Attorney, Agent, or Firm*—Raymond L. Coppiellie; Brooks & Kushman P.C.

(57) ABSTRACT

An apparatus and a method for forming an article and performing a secondary operation on the article in-situ. The apparatus includes a closure and a die having a cavity. A source of pressurized gas forces a portion of a sheet into contact with a forming surface having a predetermined shape. A tool is movably connected to the apparatus and is configured to engage the sheet to perform a secondary operation while the sheet is held in compression between the closure and the die.

20 Claims, 3 Drawing Sheets

APPARATUS AND METHOD FOR FORMING AN ARTICLE AND PERFORMING A SECONDARY OPERATION IN-SITU

BACKGROUND OF INVENTION

1. Field of the Invention

The present invention relates to an apparatus and a method for forming an article and performing a secondary operation on the article in-situ, and more particularly to an apparatus for superplastic forming an article and performing a cutting, flanging, and/or restrike operation on the article while the article is in the apparatus.

2. Background Art

Forming methodologies, such as superplastic forming, are used to make various metal parts. In superplastic forming, a sheet of metal having superplastic characteristics is formed into a desired shape using a die. More specifically, the die and metal sheet are heated to a temperature at which the metal sheet exhibits superplastic characteristics, then gas pressure is applied to stretch a portion of the sheet into a die cavity.

Secondary operations, such as trimming, were previously performed on the part after it was removed from the die. Performing secondary operations apart from the die increases facilities and tooling costs, labor costs, floor space requirements, and overall process cycle time. In addition, the use of separate secondary operations reduces part quality due to warpage that occurs if the part is removed from the die before it is sufficiently cooled, mishandling, and misalignment if parts are improperly refixtured to perform a secondary operation.

Before applicant's invention, there was a need for an apparatus and a method for forming an article and performing secondary operations in-situ to reduce costs and improve quality. Problems associated with the prior art as noted above and other problems are addressed by applicant's invention as summarized below.

SUMMARY OF INVENTION

According to one aspect of the present invention, an apparatus for superplastic forming an article and performing a secondary operation on the article in-situ is provided. The apparatus includes a die having a cavity having a forming surface of a predetermined shape. A closure seals against the die. A source of pressurized gas is supplied to force a sheet located between the cavity and the closure into contact with the cavity and form a portion of the sheet into the forming surface. A tool is movably connected to the apparatus and is configured to perform a secondary operation on the sheet. The tool is advanced to perform the secondary operation while the sheet is held in compression between the cavity and closure and in contact with the forming surface.

The tool may be disposed adjacent to the perimeter of the die or closure. The apparatus may include an aperture adapted to receive the tool. The aperture may be disposed in the die, the closure, and/or outside the cavity.

According to another aspect of the invention, an apparatus for shaping an article made from a metal sheet and performing a secondary operation on the article in-situ is provided. The apparatus includes first and second die members and a source of pressurized gas. The first die member includes a cavity defining a predetermined shape and an aperture. A tool is disposed in the aperture and is slidably engageable with the article. The second die member includes an inlet for providing pressurized gas to force the metal sheet against the cavity to shape the article. The tool is advanced to perform a secondary operation on the article after the article is shaped and before the article is removed from the cavity.

The secondary operation may be a cutting operation performed with a cutting tool, a flanging operation performed with a flanging tool, and/or restrike operation performed with a restrike tool. The second die member may include an indentation for receiving the tool when the tool is advanced.

According to another aspect of the invention, a method for making an article with a superplastic forming apparatus is provided. A metal sheet is secured between the die and the closure. A portion of the metal sheet is superplastic formed into a predetermined shape corresponding to a cavity in the die. A tool is advanced to engage the article and perform a secondary operation on the article when the article is secured between the die and the closure. The tool is retracted and the die and the closure are moved apart to allow the article to be removed from the die.

The step of advancing the tool to engage the article may occur while a portion of the sheet is being superplastic formed. The step of advancing the tool to engage the article may include providing a pressurized gas to force the metal sheet against the tool and keeping the tool advanced until the metal sheet retains a shape imparted by the tool. The step of retracting the tool may occur after the die and closure are moved apart.

DETAILED DESCRIPTION

Figure 1:
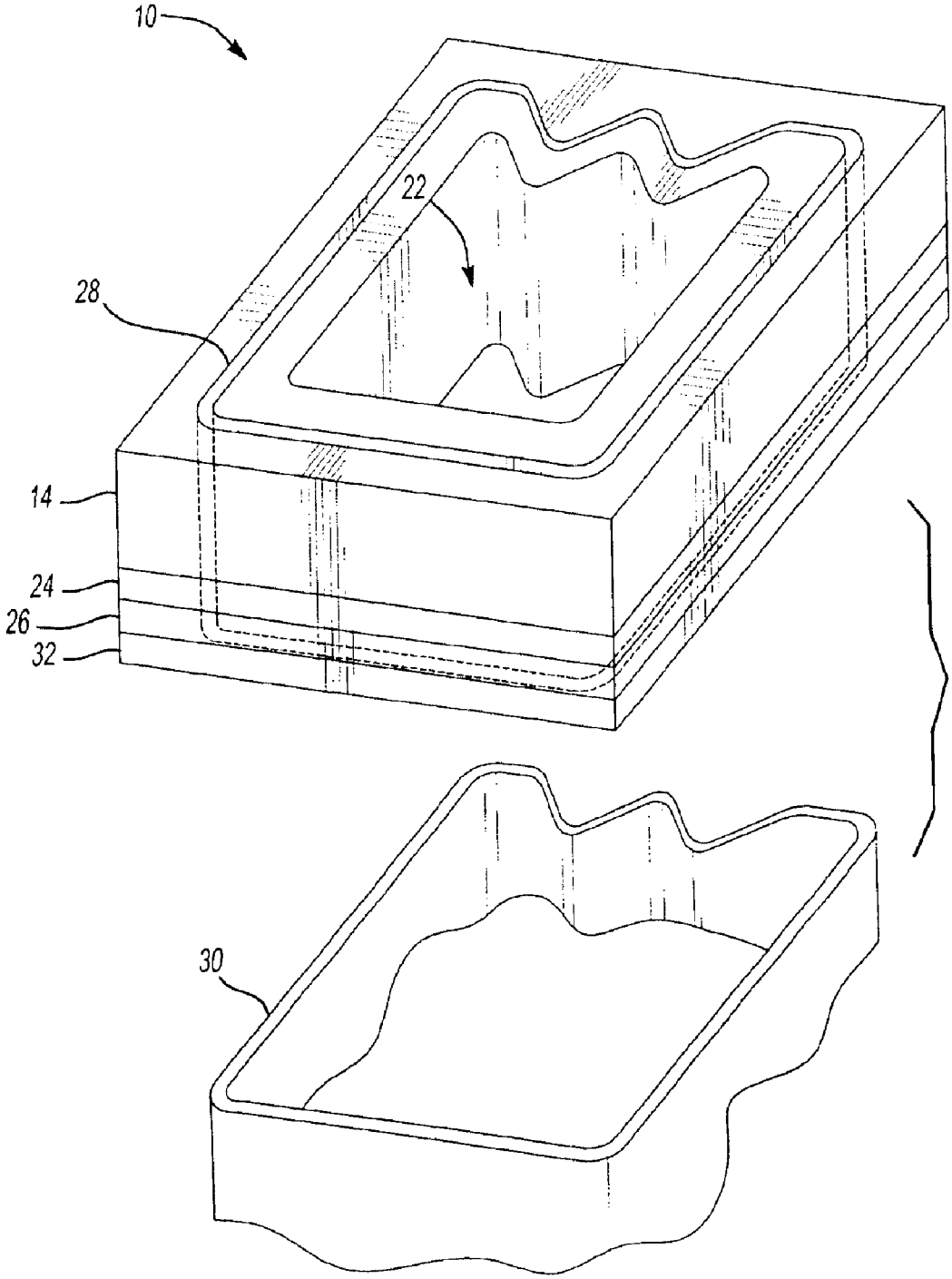
FIG. 1 is a perspective view of a portion of an apparatus for forming an article and performing a secondary operation in-situ.
Figure 2A:
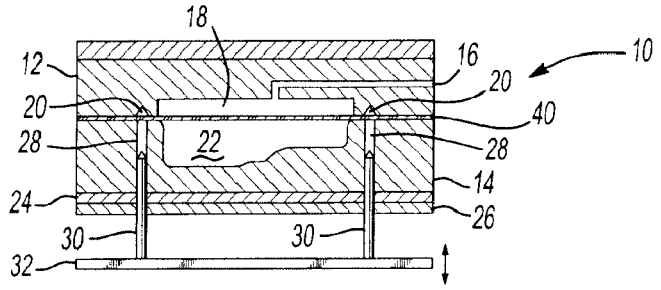
FIGS. 2A–2C are section views of a first embodiment of the present invention incorporating a cutting operation having a tool disposed in a die.

Referring to FIGS. 1 and 2A, a forming apparatus 10 is shown. The forming apparatus 10 may be used with any suitable forming methodology, such as superplastic forming or hot blow forming. The forming apparatus 10 may be configured to form one or more parts that have the same or different shapes.

The forming apparatus 10 includes a die lid or closure 12 and a die 14. In the embodiment shown in FIG. 2A, the closure 12 is positioned above the die 14. Alternately, the closure 12 may be positioned below the die 14 in any embodiment.

The closure 12 and/or die 14 may be moveable with respect to each other. Movement may be accomplished using any suitable mechanism, such as hydraulic, pneumatic, or mechanical devices.

In FIG. 2A, the closure 12 includes an inlet 16 and a cavity 18. The inlet 16 is adapted to provide a pressurized gas, such as air, to the cavity 18. The flow of gas may be regulated in any suitable manner, such as with a valve (not shown). Optionally, the closure 12 may include a groove or indentation 20 the function of which will be described in detail below. The closure 12 is adapted to seal against the die 14 to inhibit leakage of pressurized gas.

The die 14 includes a second cavity 22 having a predetermined shape. The die 14 may include multiple cavities for forming more than one part. The die 14 may also include a heated platen 24 for heating the die 14 and a cooling plate 26 for cooling the die 14. The heated platen 24 and cooling plate 26 may also support the die 14.

In the embodiment shown in FIGS. 1 and 2A–2C, the die 14 includes an aperture 28 and a tool 30 movably disposed in the aperture 28. In FIG. 1, the tool 30 is shown apart from the die 14 for clarity. The aperture 28 and tool 30 may be disposed anywhere in the closure 12 or die 14. For example, the aperture 28 and tool 30 may be disposed between the outside surface of the die 14 and the perimeter of the second cavity 22. Alternately, at least a portion of the aperture 28 and tool 30 may be disposed in the second cavity 22. Optionally, more than one aperture 28 and tool 30 may be used. For instance, a first aperture may be located in the second cavity 22 and a second aperture may be located outside the second cavity 22.

The tool 30 may have any suitable configuration for the secondary operation being performed. The secondary operations may include cutting, flanging, and/or restriking. The term "cutting" refers to any operation that severs a portion of the part, such as a trimming or piercing operation.

Referring to FIG. 2A, the tool 30 is connected to a movable member 32. The movable member 32 may be advanced and retracted to position the tool 30 using any suitable mechanism, such as hydraulic, pneumatic, and/or mechanical devices.

A metal sheet 40 is used to form one or more parts. The metal sheet 40 may be made from any suitable material that exhibits superplastic properties, such as aluminum, magnesium, steel, or titanium.

The metal sheet 40 is positioned between the closure 12 and the die 14 to form a part. A seal is created between the closure 12, the die 14, and the metal sheet 40 when the forming apparatus 10 is closed. Pressurized gas is provided via inlet 16 to the cavity 18 to create a pressure differential between cavities 18 and 22, respectively, to facilitate forming of the part. Optionally, a sealing bead and a corresponding groove may be disposed on the closure 12 and the die 14 to promote sealing.

Figure 2B:
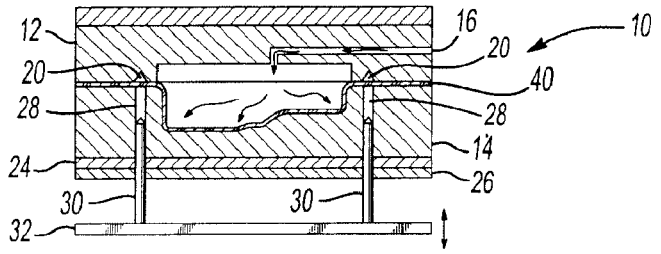
Figure 2C:
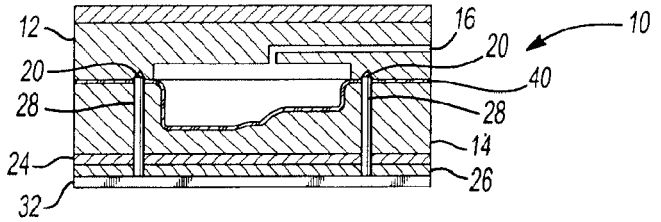

Referring to FIGS. 2A–2C, one embodiment of the invention is shown. This embodiment is representative of a cutting operation, such as trimming or piercing. In this embodiment, the aperture 28 and tool 30 are located adjacent to the second cavity 22. The tool 30 may be made of any suitable material and may have any suitable configuration, such as a sharpened tip for piercing or an edge for trimming. The tool 30 may be configured to contact the sheet 40 in a localized area or to encompass the second cavity 22 to cut the formed part out of the metal sheet 40 as shown in FIG. 1.

A method for performing a cutting operation will now be described in more detail. In FIG. 2A, the tool 30 and movable member 32 are shown in a retracted position and the metal sheet 40 is shown before it is formed.

In FIG. 2B, the metal sheet 40 is shown after being formed into a desired shape. More particularly, the metal sheet 40 is shown proximate to the second cavity 22.

In FIG. 2C, the tool 30 is shown in an advanced position to perform the secondary cutting operation. More particularly, the movable member 32 is advanced to position the tool 30 in contact with the metal sheet 40. In this embodiment, the tool 30 passes through the metal sheet 40 into the indentation 20 to facilitate localized deformation of the metal sheet 40 and promote a smoother cut.

Subsequently, the movable member 32 and the tool 30 may be retracted. The closure 12 and die 14 may be moved apart to permit removal of the part. The metal sheet 40 may be removed from the forming apparatus 10 in any suitable manner, such as by gas ejection, mechanical ejection, or manual removal.

Figure 3A:
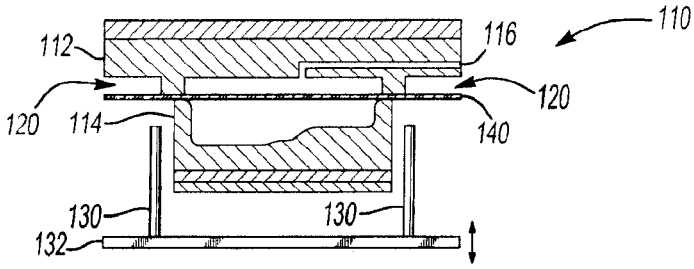
FIGS. 3A–3C are section views of a second embodiment of the present invention incorporating a cutting operation having the tool disposed adjacent to the die.
Figure 3B:
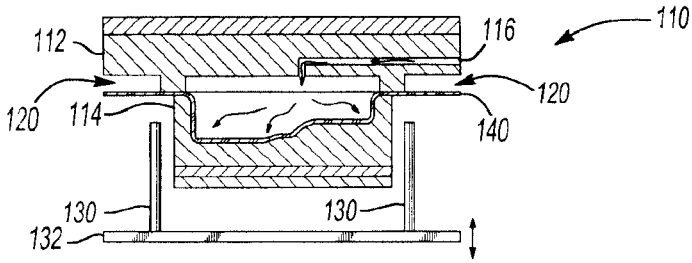
Figure 3C:
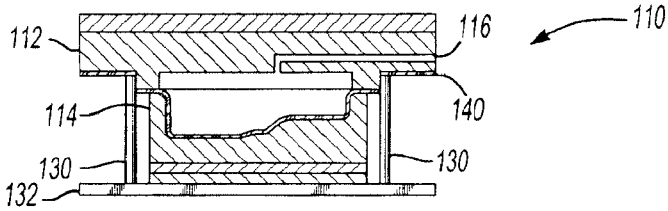

Referring to FIGS. 3A–3C, another embodiment of the invention is shown. In this embodiment, a forming apparatus 110 is configured to perform a cutting operation. The forming apparatus 110 includes a closure 112 and a die 114. The closure 112 includes an indentation that provides clearance for a cutting tool 130 when the cutting tool 130 is advanced. Since the tool 130 is located outside the die 114, the die 114 does not include an aperture.

In FIG. 3A, the tool 130 is connected to a movable member 132. The tool 130 and the moveable member 132 are shown in the retracted position and the metal sheet 140 is shown before forming.

In FIG. 3B, the metal sheet 140 is shown after being formed in the manner previously discussed.

In FIG. 3C, the tool 130 and the movable member 132 are shown in an advanced position such that the tool 130 contacts the part. In this embodiment, the indentation 120 provides clearance for the tool 130 and receives a cut portion of the metal sheet 140.

Figure 4A:
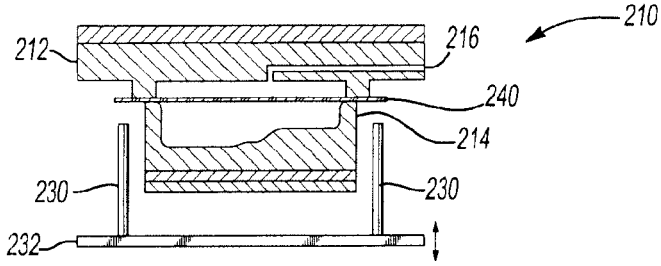
FIGS. 4A–4C are section views of a third embodiment of the present invention incorporating a flanging operation as the secondary operation.
Figure 4B:
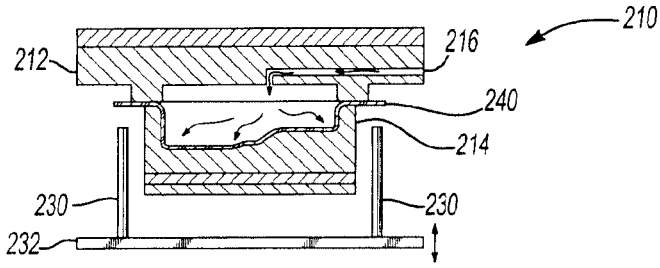
Figure 4C:
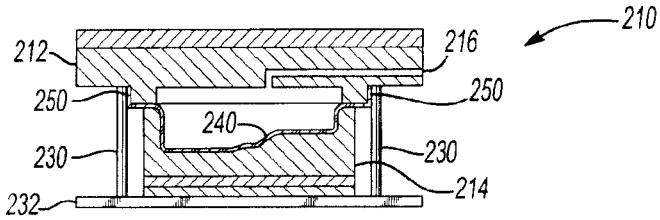

Referring to FIGS. 4A–4C, a third embodiment of the invention is shown. In this embodiment, a flanging operation is performed. The forming apparatus 210 is configured similar to that shown in FIGS. 3A–3C. The forming apparatus 210 includes a closure 212 and a die 214 as well as a forming tool 230 connected to a moveable member 232. The forming tool 230 is positioned to provide clearance for the metal sheet 240 to be shaped into a flange when the forming tool 230 is advanced.

In FIG. 4A, the forming tool 230 and the movable member 232 are shown in the retracted position and the metal sheet 240 is shown before forming.

In FIG. 4B, the metal sheet 240 is shown after being formed in the manner previously discussed.

In FIG. 4C, the forming tool 230 and the movable member 232 are shown in the advanced position. When the forming tool 230 is advanced, it contacts the portion of the metal sheet 240 that extends from the die 214 and pushes the portion against the closure 212, thereby creating a flange 250. In this embodiment, the flange 250 is shown having an L-shaped cross section. However, the flanging operation may be configured to form a flange having any suitable shape or angle.

Figure 5A:
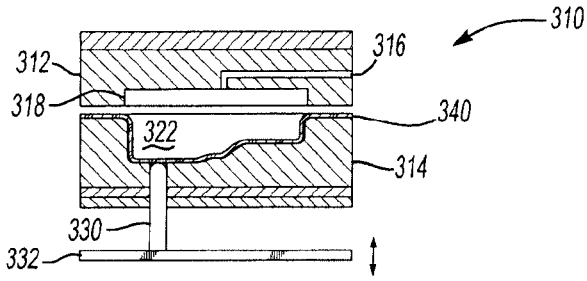
FIGS. 5A–5C are section views of a fourth embodiment of the present invention incorporating a restrike operation as the secondary operation.
Figure 5B:
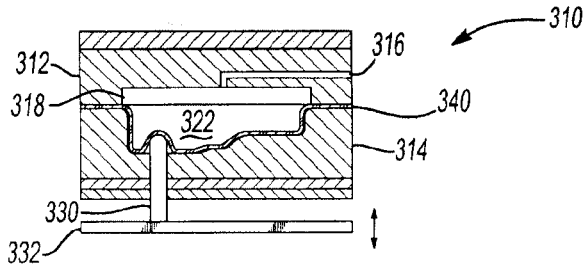
Figure 5C:
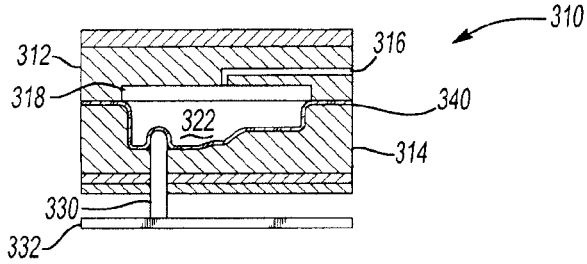

Referring to FIGS. 5A–5C, a fourth embodiment of the invention is shown. In this embodiment, a restrike operation is performed. The forming apparatus 310 includes a closure 312 and a die 314. The die 314 includes a cavity 322 and an aperture 328 located adjacent to the cavity 322. A restrike tool 330 is connected to a moveable member 332 and is shown in a retracted position in which the restrike tool does not protrude into the cavity 322. Although one restrike tool 330 is shown multiple restrike tools could be employed.

In FIG. 5A, the restrike tool 330 and the movable member 332 are shown in the retracted position and may be disposed near the surface of the cavity 322. The metal sheet 340 is shown after being formed in the manner previously discussed.

In FIG. 5B, the restrike tool 330 and the moveable member 332 are shown in the advanced position. When the restrike tool 330 is advanced, it contacts the metal sheet 340 and pushes the metal sheet 240 upward toward the closure 312.

In FIG. 5C, the pressurized gas in the cavity 318 forces the metal sheet 340 against the restrike tool 330 to create a desired shape. The restrike operation may be performed with continuous gas pressure in the cavity 318.

The embodiments previously discussed may be combined in any combination. For example, a forming apparatus may be created that includes any suitable number of cutting, flanging, and/or restriking operations. Moreover, the secondary operations and their respective tools may be located in either the closure or the die and in any suitable combinations.

While the best mode for carrying out the invention has been described in detail, those familiar with the art to which this invention relates will recognize various alternative designs and embodiments for practicing the invention as defined by the following claims.

What is claimed is:

1. An apparatus for superplastic forming an article and performing a secondary operation on the article in-situ, the apparatus comprising:

a die having a cavity, the cavity having a forming surface of a predetermined shape;

a closure disposed opposite the cavity, the closure sealing the cavity;

a source of pressurized gas being supplied to the closure to exert force against an exterior surface of a sheet located between the cavity and closure to form a portion of the sheet against the forming surface; and a tool movably connected to the apparatus and configured to perform a secondary operation on the sheet;

wherein the tool is advanced to perform the secondary operation while the sheet is held in compression between the cavity and closure and in contact with the forming surface.

2. The apparatus of claim 1 further comprising an aperture adapted to receive the tool.

3. The apparatus of claim 2 wherein the aperture is disposed in the die.

4. The apparatus of claim 3 wherein at least part of the aperture is disposed in the cavity.

5. The apparatus of claim 3 wherein the aperture is disposed outside the cavity.

6. The apparatus of claim 2 wherein the aperture is disposed in the closure.

7. The apparatus of claim 6 wherein the aperture is disposed outside a second cavity in the closure.

8. The apparatus of claim 1 wherein the tool is disposed adjacent to a perimeter of the die.

9. The apparatus of claim 1 wherein the tool is disposed adjacent to a perimeter of the closure.

10. An apparatus for shaping an article made from a metal sheet and performing a secondary operation on the article in-situ, the apparatus comprising:

a first die member having a first cavity defining a predetermined shape and an aperture;

a tool disposed in the aperture and slidably engageable with the article;

a source of pressurized gas; and a second die member having an inlet for providing pressurized gas into a second cavity disposed between the second die member and an exterior surface of the sheet to force the metal sheet against the first cavity to shape the article;

wherein the tool is advanced to perform a secondary operation on the article after the article is shaped and before the article is removed from the first cavity.

11. The apparatus of claim 10 wherein at least part of the aperture and the tool are disposed in the first cavity.

12. The apparatus of claim 10 wherein the aperture and the tool are disposed outside the first cavity.

13. The apparatus of claim 10 wherein the secondary operation is a cutting operation and the tool is a cutting tool.

14. The apparatus of claim 10 wherein the secondary operation is a flanging operation and the tool is a flanging tool.

15. The apparatus of claim 10 wherein the secondary operation is a restrike operation and the tool is a restrike tool.

16. The apparatus of claim 10 further comprising an indentation in the second die member for receiving the tool when the tool is advanced.

17. A method for making an article with a superplastic forming apparatus, the method comprising:

securing a metal sheet between a die defining a cavity and a closure;

superplastic forming a portion of the metal sheet into a predetermined shape corresponding to the cavity in the die;

advancing a tool to engage the article and perform a secondary operation on the article when the article is secured between the die and the closure;

retracting the tool;

moving the die and the closure apart; and removing the article from the die.

18. The method of claim 17 wherein the step of advancing the tool to engage the article occurs while a portion of the sheet is being superplastic formed.

19. The method of claim 17 wherein the step of advancing the tool to engage the article includes providing a pressurized gas to force the metal sheet against the tool and keeping the tool advanced until the metal sheet retains a shape imparted by the tool.

20. The method of claim 17 wherein the step of retracting the tool occurs after the die and closure are moved apart.

* * * * *